US009951405B2

(12) United States Patent
Nasserrafi et al.

(10) Patent No.: US 9,951,405 B2
(45) Date of Patent: Apr. 24, 2018

(54) LOCALIZED HEAT TREATING OF NET SHAPE TITANIUM PARTS

(71) Applicant: Spirit AeroSystems, Inc., Wichita, KS (US)

(72) Inventors: Rahbar Nasserrafi, Andover, KS (US); Steven Paul Meyer, Evans, GA (US)

(73) Assignee: Spirit AeroSystems, Inc., Wichita, KS (US)

( * ) Notice: Subject to any disclaimer, the term of this patent is extended or adjusted under 35 U.S.C. 154(b) by 363 days.

(21) Appl. No.: 14/613,437

(22) Filed: Feb. 4, 2015

(65) Prior Publication Data

US 2016/0222498 A1 Aug. 4, 2016

(51) Int. Cl.
*C22F 1/00* (2006.01)
*C22F 1/18* (2006.01)
*C22C 14/00* (2006.01)

(52) U.S. Cl.
CPC ..... *C22F 1/008* (2013.01); *C22C 14/00* (2013.01); *C22F 1/183* (2013.01)

(58) Field of Classification Search
CPC ..... C22F 1/008; C22F 1/183
See application file for complete search history.

(56) References Cited

U.S. PATENT DOCUMENTS 2,898,253 A * 8/1959 Schneider ..... C22F 1/008 148/22
2,959,503 A * 11/1960 Lindson ..... C03C 3/064 148/22
3,074,828 A * 1/1963 Griffin ..... C22F 1/00 148/666
3,092,524 A * 6/1963 Giovannucci ..... C21D 1/70 148/708
3,415,691 A * 12/1968 Vyas ..... C21D 1/70 148/284
3,440,112 A * 4/1969 Ravault ..... C03C 4/00 148/22
3,470,035 A * 9/1969 Maknis ..... C21D 1/70 148/625
3,765,205 A * 10/1973 Schaumburg ..... C21C 5/44 427/193
4,062,702 A * 12/1977 Kunst ..... C23C 10/04 148/212
4,611,744 A * 9/1986 Fraser ..... B23P 6/007 228/119

(Continued)

*Primary Examiner* — Nathaniel Herzfeld
(74) *Attorney, Agent, or Firm* — Hovey Williams LLP

(57) ABSTRACT

A system and method for heat-treating a titanium part. The system may include foil, adhesive tape, and a localized heat source. The foil may include two sheets of foil made of a material more reactive (more prone to oxidize) than the titanium part, and the localized heat source may include a heating element mostly surrounded by insulation. The method may include taping the foil to opposing sides of the titanium part, thus sealing a portion of the titanium part to be heat treated from external atmosphere. The method may also include heating and placing the localized heat source near or against the foil until heat treating is complete. A small amount of air remaining between the heated foil and the titanium part has a preferential reaction with the foil, since it is more reactive than the titanium part. This prevents oxidation of the titanium part during localized heat treating.

18 Claims, 2 Drawing Sheets

(56) References Cited

U.S. PATENT DOCUMENTS

| | | | | |
|---|---|---|---|---|
| 5,185,513 | A * | 2/1993 | Pacileo | B23K 3/033 219/494 |
| 5,330,813 | A * | 7/1994 | Hirooka | C21D 1/72 148/206 |
| 5,439,534 | A * | 8/1995 | Takeuchi | H01F 41/0226 148/105 |
| 7,358,466 | B1 * | 4/2008 | Myers | F01D 5/34 219/201 |
| 2002/0195176 | A1 * | 12/2002 | Smith | C22C 19/053 148/427 |
| 2003/0207079 | A1 * | 11/2003 | Subramanian | C23C 4/18 428/136 |
| 2009/0065494 | A1 * | 3/2009 | DeMichael | B23P 6/002 219/482 |
| 2014/0061165 | A1 * | 3/2014 | Stempfer | B22F 3/1055 219/73.21 |
| 2014/0117007 | A1 * | 5/2014 | Trapp | C21D 9/0068 219/601 |
| 2016/0046088 | A1 * | 2/2016 | Haag | B29C 73/02 427/535 |

* cited by examiner

LOCALIZED HEAT TREATING OF NET SHAPE TITANIUM PARTS

BACKGROUND

Titanium is used in many applications requiring high strength but relatively low weight parts and components. Titanium is highly reactive (i.e., prone to oxidize) when formed under heat and/or welded at temperatures of over 500° F., and particularly over temperatures of 900° F. However, these high temperatures are sometimes required for weld repair processes and heat treatments, which may be necessary to fix mis-drilled holes, oversize holes, dents in the surface of a honeycomb panel, etc. At these high temperatures, the titanium may react with oxygen in the air and other contaminants present, becoming brittle and prone to cracking unless properly shielded from atmospheric gasses.

Conventional heat treating for stress relief of net or near net shape titanium parts are performed inside a vacuum furnace or alternatively in an argon chamber to prevent surface reaction/contamination when titanium is at heat treatment temperature. For example, the titanium requiring heating may be prevented from reacting with components of air, water, oxygen, and carbon dioxide by insertion into an enclosed chamber or vacuum furnace evacuated of air and other contaminants. A high vacuum removes air from within the chamber, and an inert gas, such as argon, may be introduced in its place. However, the equipment for this technique can be expensive and involves placing the entire part into the chamber for heating. The entire titanium part is therefore heated, even though only a portion of the part may actually require heat treating. In the case of repair, the titanium part may need to be removed entirely from an aircraft to be placed into the chamber.

Thus, prior art methods of heat-treating titanium tend to be inefficient, expensive, and time-consuming.

SUMMARY OF THE INVENTION

Embodiments of the present invention solve the above-mentioned problems and provide a distinct advance in the art of heat-treating titanium parts. Specifically, embodiments of the present invention may provide a system and method for heat-treating a titanium parts without unwanted oxidation of the titanium part and without placing the entire part in a vacuum furnace or oven.

One embodiment of the invention provides a method for heat-treating a titanium part. The method may include applying foil to at least one side or surface of the titanium part and taping all sides of the foil with adhesive tape to the titanium part. This seals a portion of the titanium part to be heat treated from external atmosphere. The foil may be made of a material more prone to oxidize than the titanium part and may be sized to cover the portion of the titanium part to be heat treated. Next, the method may include heating the foil at locations covering the portion of the titanium part to be heat treated. This heating may include heating a localized heat source, and placing the localized heat source near or against the foil.

Another embodiment of the invention is similar to the above-described embodiment, but includes applying a foil more prone to oxidize than the titanium part to opposing sides or opposing surfaces of a titanium part and taping all sides of the foil with adhesive tape to the titanium part. The method then includes heating a localized heat source and placing the localized heat source near or against the foil at locations covering the portion of the titanium part to be heat treated. The localized heat source may include a heating element surrounded by an insulation element designed to localize the heat applied to the foil.

Yet another embodiment of the invention provides a method for heat-treating a titanium part, including determining how far out edges of a foil should extend from a portion of the titanium part to be heat treated or how far away an adhesive tape should be placed from the portion of the titanium part to be heat treated to keep the adhesive tape at a temperature below approximately 350° F. or below a maximum temperature of the selected type of adhesive tape. This determination may be made using finite element modeling (FEM) or experimentation. The method may further include applying a foil more prone to oxidize than the titanium part to opposing sides or opposing surfaces of the titanium part and taping all sides of the foil with adhesive tape to the titanium part. The foil may include two sheets of foil sized and shaped according to the determining step above. The method then includes heating a localized heat source to a temperature in a range of 900° F. to 1400° F. and placing the localized heat source near or against the foil at locations covering the portion of the titanium part to be heat treated for 15 minutes to 24 hours. The localized heat source may include a heating element surrounded by an insulation element designed to localize the heat applied to the foil.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
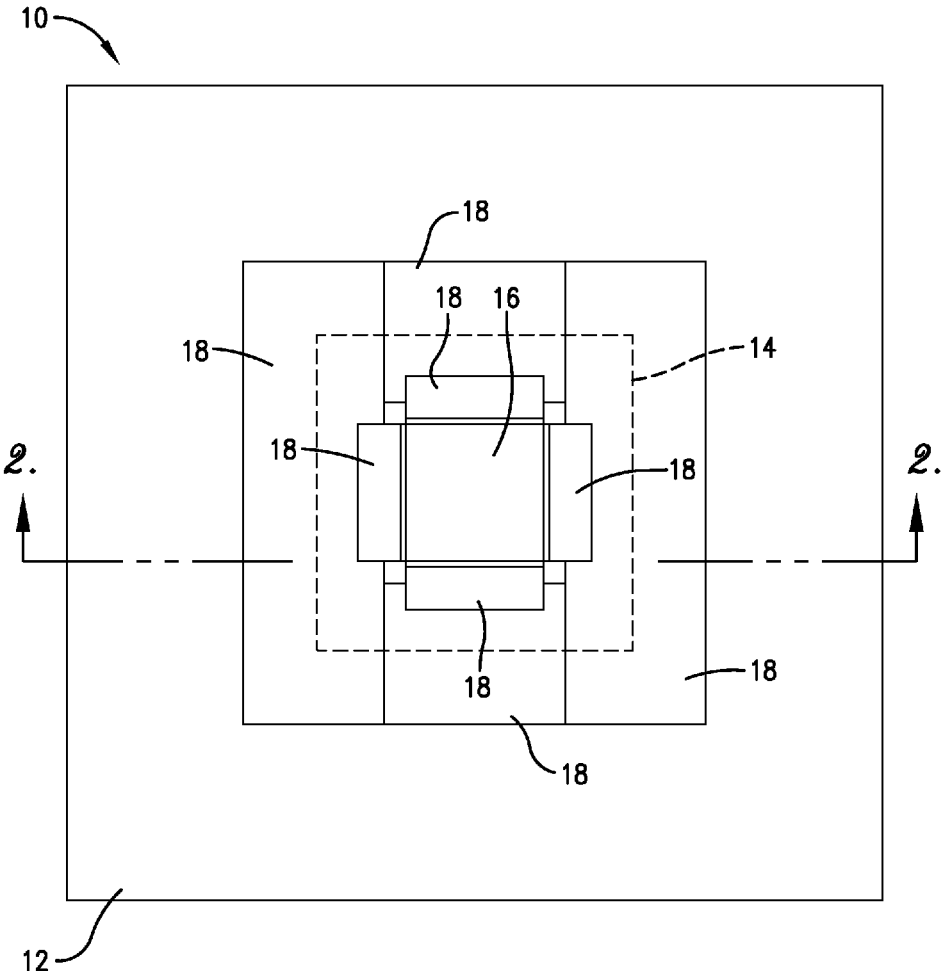
FIG. 1 is a top plan view of a titanium part and a localized heat-treating system constructed in accordance with various embodiments of the present invention.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 2:
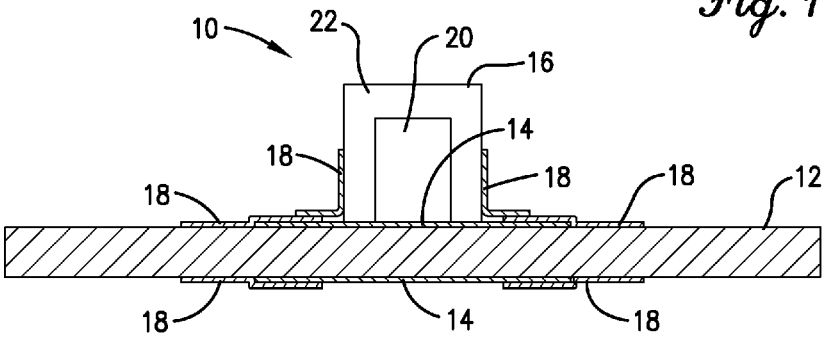
FIG. 2 is a cross-sectional view of the localized heat-treating system of FIG. 1, taken along line 2-2.
Figure 3:
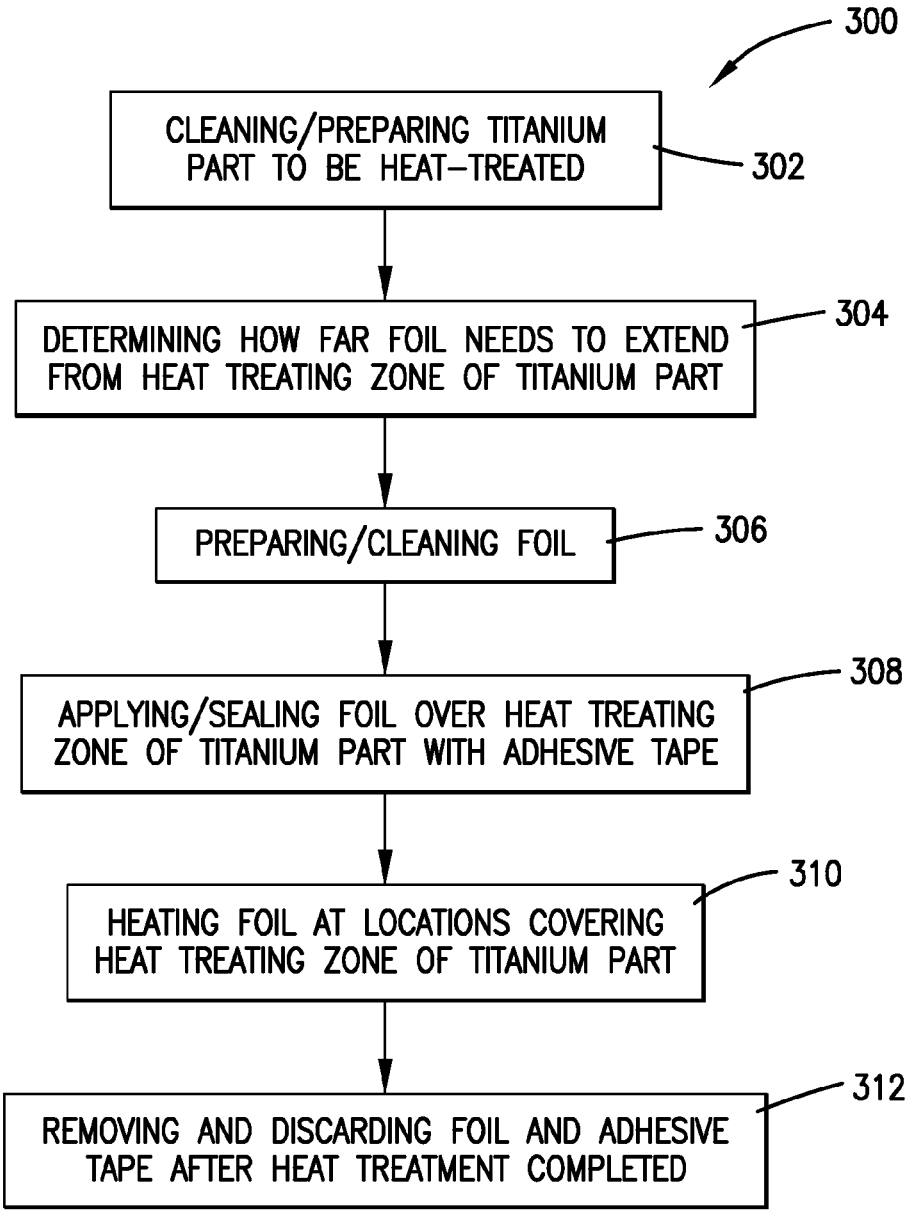
FIG. 3 is a flow diagram of steps of a method for heat treating a titanium part in accordance with various embodiments of the present invention.

A localized heat-treating system 10 constructed in accordance with embodiments of the present invention is shown in FIGS. 1-3. Embodiments of the invention are configured for heat treating a titanium part 12. The localized heat-treating system 10 may comprise one or more sheets of foil 14 and a localized heat source 16. In some embodiments of the invention, the localized heat-treating system 10 may also comprise adhesive tape 18 for attaching the foil 14 to the titanium part 12.

The titanium part 12 may be a solid piece of titanium having opposing surfaces and a plurality of edges. The titanium part 12 may have any shape, size, or configuration, and may include, for example, Ti-6Al2Sn-4Zr-2Cr, Beta 21s, and/or Ti-6-Al-4V. Furthermore, the titanium part 12 may be a net shape part, a near net shape part, and/or a rough part. In some embodiments of the invention, the titanium part 12 may have a shape or configuration that is very challenging to purge with argon, as in prior art heat-treating methods. The titanium part 12 may include, for example, components of an aircraft nacelle's pylon or thrust reverser, such as a wall panel or the like. Furthermore, the titanium part 12 may include pylon chards, jet engine compressor blades, jet engine compressor cases, titanium frames for a fuselage or prolusion application, nose wheel well chords, fan disks, forged rings, landing gear forgings, disks, welded titanium fabrications, titanium transmission cases, welded tubing, offshore oil drilling rig components, subsea equipment, chemical processing parts, and the like which require stress relieve after forming, welding, and/or straightening operations.

The foil 14 may include one or more sheets of foil with opposing surfaces and a plurality of edges. The foil 14 may be made of any material more reactive with ambient atmosphere than the titanium part 12 or more prone to oxidize than the titanium part 12, while also having a high melting point and a high burning point higher than heat-treating temperatures to be used. The foil 14 may also be a material that reacts sooner and more aggressively with oxygen, nitrogen, carbon dioxide, and water vapor than the titanium part 12. In some embodiments of the invention, the foil 14 may comprise sacrificial CP Titanium (grades 1 to 4), TI-3AL-2.5V, Ti-15V-3Cr-3Sn-3Al, and/or Zirconium. The foil 14 may have any dimensions desired for a given application. For example, the foil 14 may have a thickness in a range of 0.001 inches to 0.030 inches, or more specifically may have a thickness in a range of 0.001 inches to 0.008 inches. An area or length and width of the foil 14 may be determined via finite element modeling (FEM), testing, and/or experimentation, such as placing thermocouples around the localized heat source 16 to determine at what point the temperature no longer remains safely below the recommended use temperature for the adhesive tape 18.

The localized heat source 16 may be a resistance heater, infra-red radiation heater, induction heater, or any other heat source configured to provide uniform heating temperatures with direct radiation, convection, or the like. The localized heat source 16 may comprise a heating element 20 and an insulating element 22 configured for electrically isolating the heating element 20. For example, the insulating element 22 may comprise a ceramic blanket or other insulating materials wrapped around most or the entire heating element 20. In some embodiments of the invention, the localized heat source 16 may be encapsulated and purged with an inert gas such as argon to reduce the risk for oxidation.

The localized heat source 16 may be of any size or shape, depending on a size and shape of an area to be heat-treated on the titanium part 12, also referred to herein as the "heat treating zone." For example, the heat treating zone may be approximately 0.25 inches in diameter to approximately 6 inches in diameter. Alternatively, the heat treating zone may have a length and/or width of approximately 0.25 inches in diameter to approximately 6 inches in diameter for square applications, or an area of approximately 0.05 square inches to 10 square inches for rectangular or irregularly shaped applications. In general, the localized heat source 16 may be a small, portable heater designed for field repair of the titanium part 12. The localized heat source 16 may be configured to provide temperatures of 900° F. to 1,400° F. for anywhere from 15 minutes to 24 hours. However, the localized heat source 16 may be capable of other temperatures and durations without departing from the scope of the invention.

In some embodiments of the invention, the localized heat source 16 may include or be electrically coupled with an electronic controller configured to control heating times, temperatures, and ramp-up/ramp-down rates. Furthermore temperature sensors may be placed on the titanium part 12 and/or at critical locations on the localized heat source 16 and may provide temperature feedback readings to the electronic controller. The electronic controller may be programmed and/or configured to use these readings to adjust heating times, temperatures, and ramp-up/ramp-down rates accordingly.

The adhesive tape 18 may be any sealing adhesive tapes capable of withstanding temperatures above 250° F.-350° F. and/or up to 600° F. (depending on the type of tape used) and not become brittle or otherwise deformed. For example, the adhesive tape 18 may comprise Kapton, aluminum, nylon, or silicone tapes. The adhesive tape 18 may be configured to effective attach the foil 14 onto the titanium part 12 and seal a surface portion of the titanium part 12 from ambient atmosphere with a minimum gap between the foil 14 and the titanium part, as described below.

In use, the localized heat-treating system 10 described above may be used to locally heat-treat the titanium part. In general, the foil 14 may be applied to both sides of the titanium part 12 and sealed thereto to prevent oxygen/interstitial element pick up at both sides of the titanium part 12. Once any space between the foil 14 and the heat treating zone of the titanium part 12 is sealed off from external atmosphere, the localized heat source 16 may be heated and placed near or against the foil 14 at locations corresponding to the heat treating zone of the titanium part 12. The foil 14 may be removed and discarded after the heat treatment, and the titanium part 12 may be examined for any discoloration or other indications of oxidation.

Method steps for localized heat-treating of the titanium part 12 will now be described in more detail. Specifically, FIG. 3 illustrates steps in a method 300 for heat treating the titanium part 12, in accordance with various embodiments of the present invention. The steps of the method 300 may be performed in the order as shown in FIG. 3, or they may be performed in a different order. Furthermore, some steps may be performed concurrently as opposed to sequentially. In addition, some steps may not be performed.

The method 300 may include a step of cleaning or otherwise preparing a surface of the titanium part 12 to be heat-treated, as depicted in block 302. For example, this cleaning step may include acid cleaning of surfaces of the titanium part 12 to remove deposits or other contaminants. However, this cleaning step may be omitted without departing from the scope of the invention.

Next, the method 300 may include a step of determining how far the foil 14 needs to extend from the portion of the titanium part 12 to be heat treated, as depicted in block 304, such that the adhesive tape 18 is not exposed to too high a temperature. The foil 14 must extend far enough from the localized heat source 16 to keep the adhesive tape 18 from over-heating throughout the duration of the localized heat treating needed by the titanium part 12, such that the adhesive tape 18 effectively attaches the foil 14 onto the titanium part 12 and seals it from ambient atmosphere with a minimum gap between the foil 14 and the titanium part 12.

The determining step 304 may be achieved using finite element modeling (FEM), other modeling techniques, and/or through experimentation, and may depend on a number of variables. For example, the adhesive tape 18 may be required to remain below 600° F. if the adhesive tape 18 contains Kapton, or may be required to remain below 350° F. if the adhesive tape 18 is an aluminum, nylon, or silicone tape, so that the adhesive tape 18 does not lose the ability to effectively attach the foil 14 to the titanium part 12. Other tapes may be able to withstand higher temperatures.

The determining step 304 may also depend on characteristics of the localized heat source 16. In some embodiments of the invention, localized heat treatment using effective insulation material may allow a portion of the foil 14 directly in contact with the localized heat source 16 (i.e., portions of the foil 14 covering the heat treating zone) to be heated as high as approximately 1,500° F., while keeping temperatures of portions of the foil 14 outside of the heat treating zone below approximately 300° F. The heat treating zone size may also be a variable considered in the determining step 304. In general, the further the edges of the foil 14 extend from the heat treating zone, the cooler the adhesive tape 18 adhering to the titanium part 12 and the foil 14 will be.

Next, the method 300 may include a step of preparing the foil 14, as depicted in block 306. This may include cutting or otherwise manufacturing one or two sheets of the foil 14 to the determined sizes and cleaning the foil surfaces for removal of contaminants using any foil cleaning processes known in the art. Then the method 300 may include a step of applying the foil 14 to one or both sides of the titanium part 12, as depicted in block 308, to prevent oxygen/interstitial element pick up at both sides of the titanium part 12. Specifically, the preparing step 306 may include cleaning the foil 14 and handling the foil in such a way as to prevent contamination. The applying step 308 may include taping all sides of the foil 14 with the adhesive tape 18 to seal off any space between the foil 14 and the titanium part 12 from external atmosphere. If needed, a small opening or pinhole can be added through the adhesive tape 18 and/or the foil 14 to allow for outgassing. In some embodiments of the invention, the adhesive tape 18 may also seal the insulating element 22 to other portions of the adhesive tape 18, the foil 14, and/or the titanium part 12, providing additional sealing off of the heat treating zone from ambient atmosphere.

In some embodiments of the invention, opposing surfaces of the titanium part 12 are covered with the foil 14. That is, two separate sheets of the foil 14 are taped to the titanium part 12 with the adhesive tape 18, in order to prevent oxygen/interstitial element pick up at both sides of the heat treating zone of the titanium part 12, as illustrated in FIG. 2. Additionally, the step 308 of applying the foil 14 may include conforming the foil 14 (or sheets of the foil 14) to surfaces of the titanium part 12 and pushing air out from between the foil 14 and the titanium part 12 or otherwise minimizing any gaps between the titanium part 12 and the foil 14.

Then, the method 300 may include heating the foil 14 at locations corresponding to locations on the titanium part 12 to be heat treated, as depicted in block 310. The time and temperatures for heating the foil at the heat treating zone or zones may vary. For example, the temperatures may vary plus or minus 25° F. between a set point chosen in a range of 900° F. to 1400° F. for 15 minutes to 24 hours. Temperatures outward of the heat treating zone and outward of the insulation of the localized heat source 16 may vary from 50° F. to 325° F., with a maximum temperature of 500° F.

Specifically, the localized heat source 16 may be heated and placed near or against the foil 14 at the heat treating zone or zones. In some embodiments of the invention, the localized heat source 16 may be encapsulated or sealed and purged with an inert gas such as argon to further reduce the possibility for oxidation. However, this purging with inert gas is not generally necessary for the method 300 described herein. The heating step 310 may be programmed via an electronic controller. Furthermore, in some embodiments of the invention, the electronic controller may be communicably coupled with temperature sensors located inside and/or outside the heat treating zone. Readings from these sensors may be used by the electronic controller to determine proper times, temperatures, ramp-up/ramp-down rates, and the like.

Advantageously, taping all sides of the foil 14 to seal the gap or space between the foil 14 and the titanium part 12 prior to localized heating thereof may prevent oxidation of the heat-treated zone or surface of the titanium part 12 by preferential reaction between the heated foil 14 and a small amount of air remaining in between the heated foil 14 and the titanium part 12. That is, because the foil 14 is more reactive than the titanium part 12, the relatively small number of oxygen molecules, nitrogen molecules, and/or water molecules in the gap between the foil 14 and the titanium part 12 will be attracted to and/or consumed by the foil 14. This protects the surface of the titanium part 12 from oxidation and thus may allow localized heat treatment of titanium parts in air or under ambient atmosphere. Furthermore, because of the insulation of the localized heat source 16, areas of the titanium part 12 that extend outward of the foil 14 are not heated and thus do not oxidize either.

Furthermore, since the gap between the foil 14 and the titanium part 12 is small, the gas molecules present therebetween, and available for attacking the heated surface of titanium, are finite, and are much less than if the heated titanium part 12 was unshielded. Since the reactive foil 14 is more reactive than the titanium part 12, the foil 14 will react faster and at a lower temperature than the titanium part 12, and thereby consumes the finite volume of gaseous contaminants before they can react with the surface of the titanium part 12, thereby protecting the titanium part 12.

After heat-treating is complete, the method 300 may include a step of removing and discarding the foil 14 and the adhesive tape 18, as depicted in block 312. Specifically, the foil 14 is sacrificial in nature and can be discarded after the heat treatment is complete. Finally, the method 300 may include a step of examining the titanium part 12 for any discoloration or other indications of reaction between the titanium part 12 and the foil 14, as depicted in block 314. In some embodiments of the invention, hardness and/or conductivity may be checked for non-destructive evaluation of the heat-treated titanium part 12.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A method of heat-treating a titanium part, the method comprising:

sealing a portion of the titanium part from an external atmosphere with a solid sheet of a foil having one or more edges, including taping the one or more edges of the solid sheet of the foil to the titanium part using an adhesive tape, wherein the solid sheet of the foil is made of a material more prone to oxidize than the titanium part and is sized to cover the portion of the titanium part to be heat treated, such that the solid sheet of the foil functions both as an enclosure for physically excluding the external atmosphere and as a getter for chemically reacting with any portion of the external atmosphere trapped within the enclosure; and placing a localized heat source near or against the solid sheet of the foil at locations covering portions of the titanium part to be heat treated.

2. The method of claim 1, wherein the localized heat source comprises a heating element surrounded by an insulation element, configured to localize the heat applied to the solid sheet of the foil.

3. The method of claim 1, wherein the foil comprises two solid sheets applied on opposing sides of the titanium part.

4. The method of claim 1, further comprising a step of determining how far out edges of the solid sheet of the foil should extend from the portion of the titanium part to be heat treated or how far the adhesive tape should be placed from the portion of the titanium part to be heat treated.

5. The method of claim 1, wherein the solid sheet of the foil is made of at least one of commercially pure (CP) titanium (grades 1 to 4), TI-3AL-2.5V, Ti-15V-3Cr-3Sn-3Al, and zirconium.

6. The method of claim 1, wherein the titanium part is a net shape part, a near net shape part, or a rough part.

7. A method of heat-treating a titanium part, the method comprising:

applying one or more solid sheets of a foil having one or more edges to opposing sides or opposing surfaces of the titanium part by directly taping the one or more edges of the one or more solid sheets of the foil with an adhesive tape to the titanium part, thus sealing a portion of the titanium part to be heat treated from an external atmosphere, wherein the one or more solid sheets of the foil is made of a material more prone to oxidize than the titanium part and sized to cover the portion of the titanium part to be heat treated, such that the one or more solid sheets of the foil each function both as an enclosure for physically excluding the external atmosphere and as a getter for chemically reacting with any portion of the external atmosphere trapped within the enclosure; and heating the one or more solid sheets of the foil at locations covering the portion of the titanium part to be heat treated by placing a localized heat source near or against the one or more solid sheets of the foil, wherein the localized heat source comprises a heating element surrounded by an insulation element and is configured to localize the heat applied to the one or more solid sheets of the foil.

8. The method of claim 7, further comprising a step of determining how far out edges of the one or more solid sheets of the foil should extend from the portion of the titanium part to be heat treated or how far away the adhesive tape should be placed from the portion of the titanium part to be heat treated.

9. The method of claim 7, wherein the one or more solid sheets of the foil is made of at least one of commercially pure (CP) titanium (grades 1 to 4), TI-3AL-2.5V, Ti-15V-3Cr-3Sn-3Al, and zirconium.

10. The method of claim 7, wherein the titanium part is made of at least one of Ti-6Al2Sn-4Zr-2Cr, Beta 21s, and Ti-6-Al-4V, wherein the titanium part is a net shape part, a near net shape part, or a rough part.

11. The method of claim 7, wherein the adhesive tape is at least one of Kapton tape, aluminum tape, nylon tape, or silicone tape.

12. The method of claim 7, further comprising at least one of:

cleaning and preparing the titanium part to be heat treated, and cleaning and preparing the one or more solid sheets of the foil to be applied to the titanium part and heated.

13. A method of heat-treating a titanium part, the method comprising:

determining, using finite element modeling or experimentation, how far out edges of a foil should extend from a portion of the titanium part to be heat treated or how far away an adhesive tape should be placed from the portion of the titanium part to be heat treated to keep the adhesive tape at a temperature below approximately 600° F.;

applying the foil to opposing sides or opposing surfaces of the titanium part by directly taping all edges of the foil with the adhesive tape to the titanium part, thus sealing the portion of the titanium part to be heat treated from external atmosphere, wherein the foil is made of a material more prone to oxidize than the titanium part and sized to cover the portion of the titanium part to be heat treated, wherein the foil comprises two solid sheets sized and shaped according to the determining step, such that the solid sheets of the foil each function both as an enclosure for physically excluding the external atmosphere and as a getter for chemically reacting with any portion of the external atmosphere trapped within the enclosure; and heating the solid sheets of the foil at locations covering the portion of the titanium part to be heat treated by:

heating a localized heat source to a temperature in a range of 900° F. to 1400° F., and placing the localized heat source near or against the solid sheets of the foil for 15 minutes to 24 hours, wherein the localized heat source comprises a heating element surrounded by an insulation element and is configured to localize the heat applied to the solid sheets of the foil.

14. The method of claim 13, wherein the solid sheets of the foil is made of at least one of commercially pure (CP) titanium (grades 1 to 4), TI-3AL-2.5V, Ti-15V-3Cr-3Sn-3Al, and zirconium, wherein the titanium part is made of at least one of Ti-6Al2Sn-4Zr-2Cr, Beta 21s, and Ti-6-Al-4V, wherein the titanium part is a net shape part, a near net shape part, or a rough part, wherein the adhesive tape is at least one of Kapton tape, aluminum tape, nylon tape, or silicone tape.

15. The method of claim 13, wherein the heating step further comprises controlling the localized heat source with an electronic controller.

16. The method of claim 15, wherein the electronic controller is communicably coupled with temperature sensors located at or outward of the portion of the titanium part to be heat treated, wherein temperature readings from the temperature sensors are used by the electronic controller to control at least one of times, temperatures, ramp-up rates, and ramp-down rates for heat treating the titanium part.

17. The method of claim 13, further comprising at least one of:

cleaning and preparing the titanium part to be heat treated, and cleaning and preparing the solid sheets of the foil to be applied to the titanium part and heated.

18. The method of claim 13, further comprising a step of removing the solid sheets of the foil and the adhesive tape after heat treatment of the titanium part is complete.

* * * * *